US006948969B2

(12) United States Patent
Huang

(10) Patent No.: US 6,948,969 B2
(45) Date of Patent: Sep. 27, 2005

(54) ELECTRICAL CONNECTOR ASSEMBLY WITH A CABLE GUIDING MEMBER

(76) Inventor: George Ying-Liang Huang, 8F, No. 435, Rei-Kuang Rd., Nei-Hu Dist., Taipei City (TW)

( * ) Notice: Subject to any disclaimer, the term of this patent is extended or adjusted under 35 U.S.C. 154(b) by 0 days.

(21) Appl. No.: 10/337,740

(22) Filed: Jan. 7, 2003

(65) Prior Publication Data

US 2003/0194902 A1 Oct. 16, 2003

(51) Int. Cl.[7] ..... H01R 13/58
(52) U.S. Cl. ..... 439/457
(58) Field of Search ..... 439/457, 456, 439/468, 466, 473

(56) References Cited

U.S. PATENT DOCUMENTS 4,029,896 A * 6/1977 Skinner ..... 174/138 F
4,101,189 A * 7/1978 Moser et al. ..... 439/405
4,195,194 A * 3/1980 Kuster et al. ..... 174/59
4,869,686 A * 9/1989 Michaels et al. ..... 439/455
4,921,454 A * 5/1990 Atherton et al. ..... 439/685
5,211,706 A * 5/1993 Polgar ..... 439/464
5,731,546 A * 3/1998 Miles et al. ..... 174/135
6,065,075 A * 5/2000 Ryzin et al. ..... 710/65

* cited by examiner

*Primary Examiner*—J. F. Duverne
(74) *Attorney, Agent, or Firm*—Winstead Sechrest & Minick; Henry L. Ehrlich

(57) ABSTRACT

An electrical connector assembly includes an electric cable, and an electrical connector member for signal transmission. The connector member terminates an end portion of the electric cable. A cable guiding member is mounted on the end portion of the electric cable, and is formed with a first through hole having a first hole axis, a second through hole having a second hole axis, and a cable passage communicated with the first and second through holes. The second hole axis forms an angle with the first hole axis. The end portion of the electric cable extends into the cable passage via the first through hole and outwardly of the cable passage via the second through hole.

19 Claims, 6 Drawing Sheets

ELECTRICAL CONNECTOR ASSEMBLY WITH A CABLE GUIDING MEMBER

BACKGROUND OF THE INVENTION

1. Field of the Invention

The invention relates to a cable guiding member, more particularly to a cable guiding member that enables an electric cable terminated by an electrical connector member to be guided toward a desired direction.

2. Description of the Related Art

An electronic apparatus, such as a computer, is generally provided with at least one of a universal serial bus (USB) connecting port, a PS/2 connecting port, a COM connecting port, an LPT connecting port, a terminal connecting port, and a digital-video interface (DVI) connecting port for connecting with corresponding interface connectors. Since each of the above interface connectors is formed with a specific orientation, cable entanglement usually occurs at the back of the computer when a number of the interface connectors are connected to their corresponding connecting ports. FIG. 1 illustrates a conventional power plug 5 that is inserted into a socket 6. The conventional power plug 5 includes a plurality of terminals 51 extending along a first direction, and an electric wire 52 connected electrically to the terminals 51 and extending along a second direction transverse to the first direction. FIG. 2 illustrates a conventional connector 9 for electrical connection between a power plug (not shown) and a socket (not shown). The conventional connector 9 has a plug portion 91 that is pivotable relative to the housing of the connector 9. However, the abovementioned conventional connector 9 can only be used with a power plug, and is not adapted for use with the aforesaid interface connectors.

SUMMARY OF THE INVENTION

Therefore, the object of the present invention is to provide a cable guiding member that enables an electric cable terminated by an electrical connector member to be guided toward a desired direction.

According to one aspect of the present invention, an electrical connector assembly comprises:

an electric cable having an end portion;

an electrical connector member for signal transmission, the connector member terminating the end portion of the electric cable; and a cable guiding member mounted on the end portion of the electric cable and formed with a first through hole having a first hole axis, a second through hole having a second hole axis, and a cable passage communicated with the first and second through holes, the second hole axis forming an angle with the first hole axis, the end portion of the electric cable extending into the cable passage via the first through hole and outwardly of the cable passage via the second through hole.

According to another aspect of the present invention, a cable guiding member is adapted for use with an electric cable having an end portion terminated by an electrical connector member. The connector member includes a connector housing formed with a sleeve portion. The cable guiding member comprises:

first and second casing parts, each of which has first and second notches, the first notches of the first and second casing parts confining a first through hole with a first hole axis, the second notches of the first and second casing parts confining a second through hole with a second hole axis, the first and second casing parts further confining a cable passage communicated with the first and second through holes, the second hole axis forming an angle with the first hole axis, the first and second casing parts being adapted to permit the end portion of the electric cable to extend into the cable passage via the first through hole and outwardly of the cable passage via the second through hole, the first and second casing parts being adapted to permit the sleeve portion of the connector housing to extend into the cable passage via the first through hole;

a positioning unit disposed in at least one of the first and second casing parts and adapted to engage the sleeve portion of the connector housing; and a fastening unit for fastening together the first and second casing parts.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
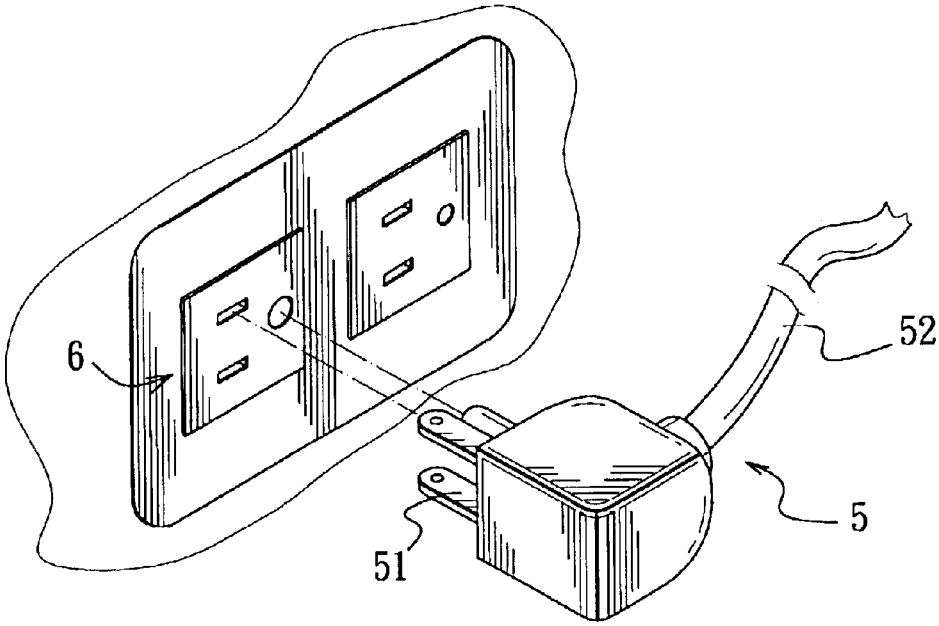
F I G. 1 PRIOR ART
FIG. 1 is a perspective view showing a combination of a conventional power plug and a socket.
Figure 2:
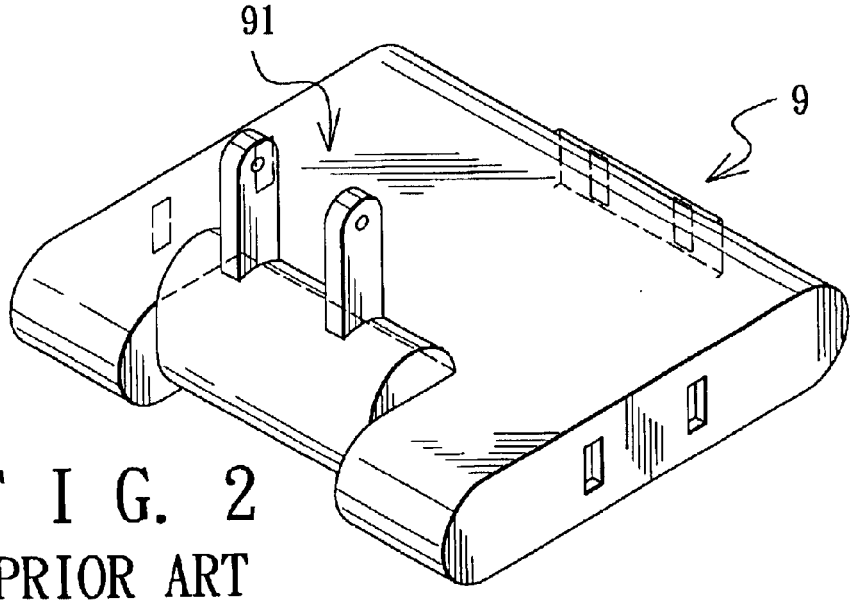
F I G. 2 PRIOR ART
FIG. 2 is a perspective view showing a conventional power connector.

Before the present invention is described in greater detail, it should be noted that like elements are denoted by the same reference numerals throughout the disclosure.

Figure 3:
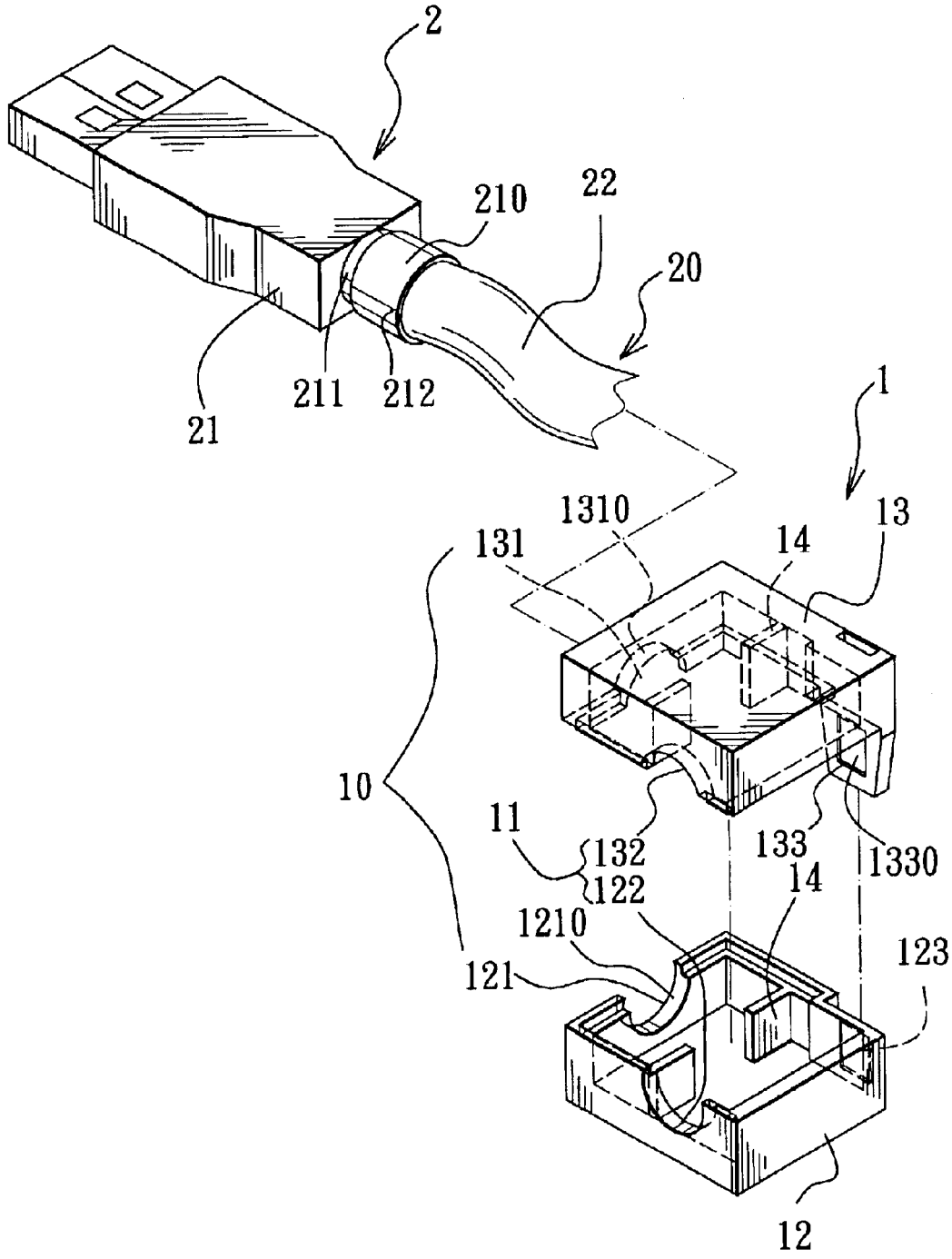
FIG. 3 is an partly exploded perspective view showing the first preferred embodiment of an electrical connector assembly according to the present invention.
Figure 4:
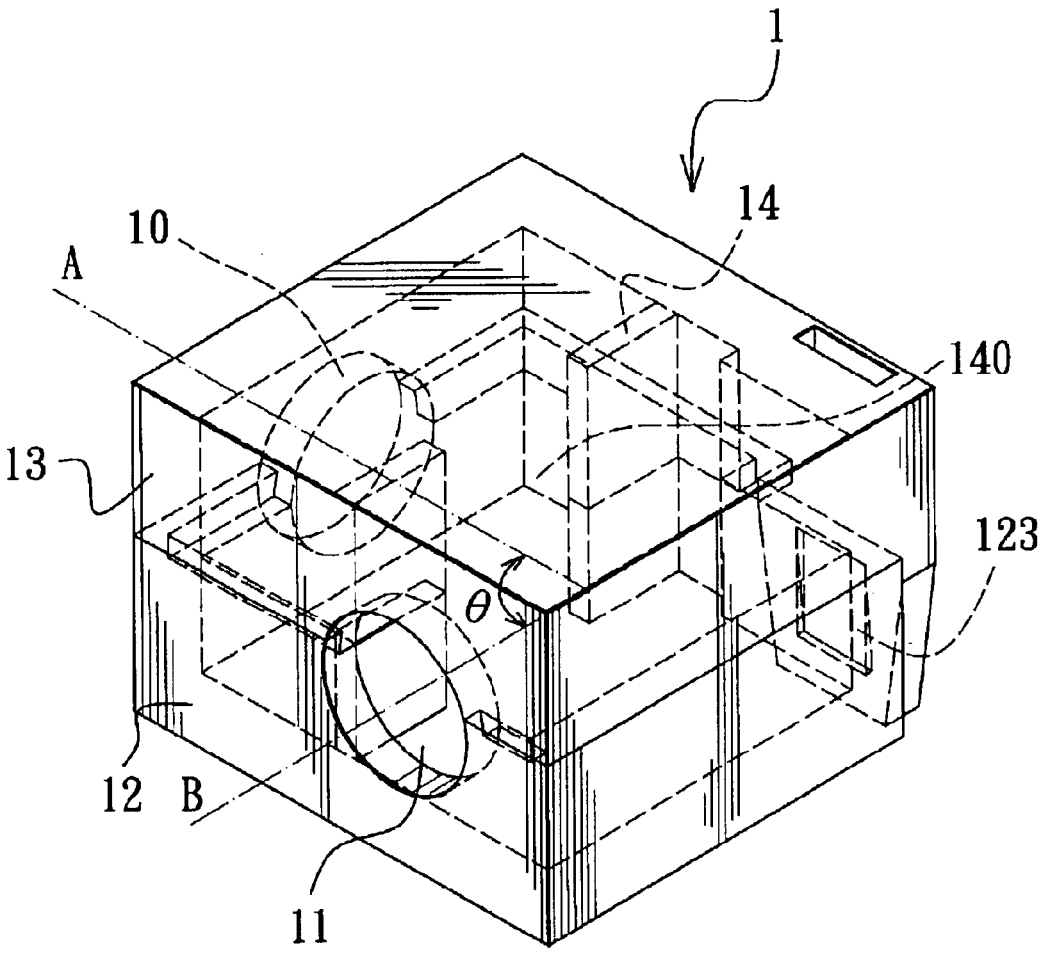
FIG. 4 is a perspective view showing a cable guiding member of the first preferred embodiment.
Figure 5:
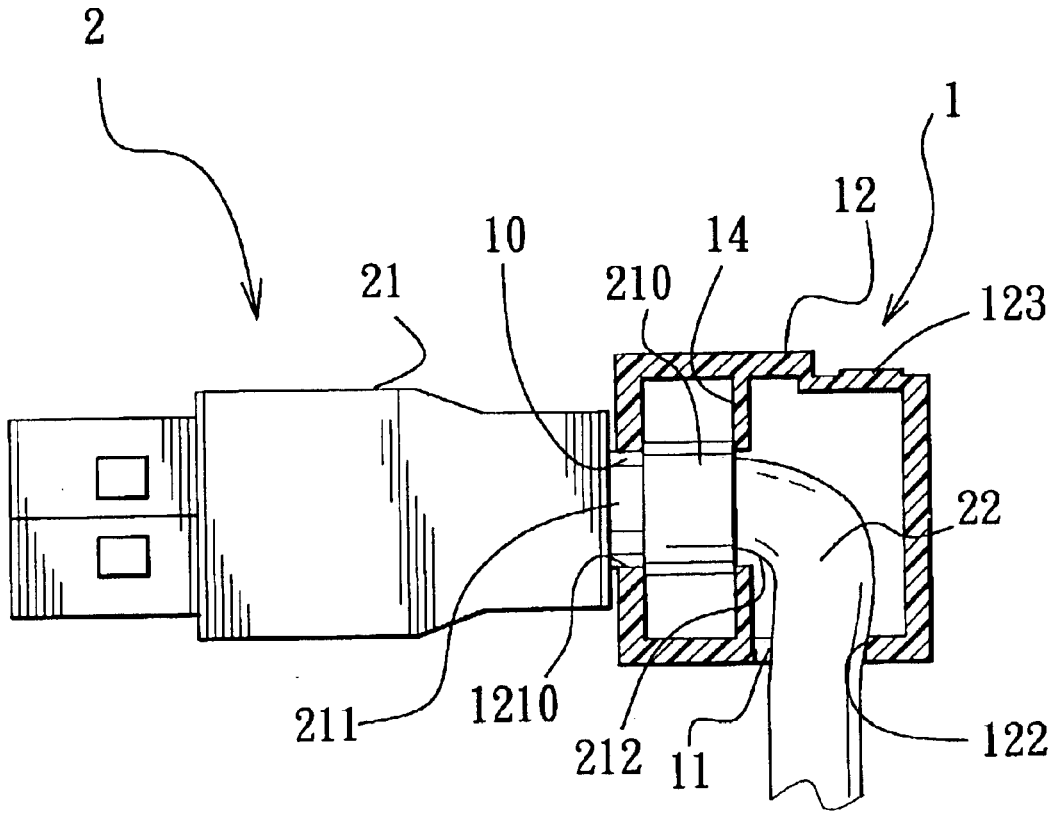
FIG. 5 is a partly sectional, top schematic view showing the first preferred embodiment.

Referring to FIGS. 3 to 5, the first preferred embodiment of an electrical connector assembly according to the present invention is shown to include an electric cable 20, an electrical connector member 2 for signal transmission, and a cable guiding member 1.

The electric cable 20, which consists of a plurality of signal transmission lines (not shown), has an end portion 22.

The electrical connector member 2, such as a USB connector, terminates the end portion 22 of the electric cable 20. The connector member may also be one of a USB connector, a PS/2 connector, a COM connector, an LPT connector and a digital video interface connector. In this embodiment, the connector member 2 includes a connector housing 21 formed with a sleeve portion 210. The sleeve portion 210 is formed with an annular engaging groove 211.

The cable guiding member 1 is mounted on the end portion 22 of the electric cable 20, and is formed with a first through hole 10 having a first hole axis (A), a second through hole having a second hole (B), and a cable passage communicated with the first and second through holes 10, 11. The second hole axis (B) forms an angle (θ) with the first hole axis (A). In this embodiment, the angle (θ) is equal to 90 degrees, i.e., the second hole axis (B) is transverse to the first hole axis (A), as best shown in FIG. 4. The end portion 22 of the electric cable 20 extends into the cable passage via the first through hole 10 and outwardly of the cable passage via the second through hole 11. In this embodiment, the cable guiding member 1 includes first and second casing parts 12, 13. The first casing part 12 has first and second notches 121, 122. The second casing part 13 has first and second notches 131, 132. The first notches 121, 131 of the first and second casing parts 12, 13 confine the first through hole 10. The second notches 122, 132 of the first and second casing parts 12, 13 confine the second through hole 11. It is noted that the cable guiding member 1 may be formed with more than one second through hole 11 so as to provide various choices of the angle (θ). The sleeve portion 210 of the connector housing 21 extends into the cable passage via the first through hole 10. The first notch 121 of the first casing part 12 is formed with an engaging edge 1210. The second notch 131 of the second casing part 13 is formed with an engaging edge 1310. Each of the engaging edges 1210, 1310 engages the engaging groove 211 in the sleeve portion 210 of the connector housing 21 to secure the connector member 2 to the cable guising member 1.

The cable guiding member 1 further includes a fastening unit for fastening together the first and second casing parts 12, 13. In this embodiment, the fastening unit includes a resilient lug 133 formed on the second casing part 13, and a projecting block 123 formed on the first casing part 12. The lug 133 is formed with an engaging hole 1330 that engages the projecting block 123 to fasten releasably the first and second casing parts 12, 13 to each other. It is noted that the first and second casing parts 12, 13 can also be fastened together with the use of screws.

The cable guiding member 1 further includes a positioning unit disposed therein for engaging the sleeve portion 210 of the connector housing 21. In this embodiment, the positioning unit includes a baffle unit that abuts against a distal end 212 of the sleeve portion 210. The baffle unit includes two pairs of baffle plates 14 that are formed integrally with the first and second casing parts 12, 13. The baffle plates 14 confine an opening 140 (see FIG. 4) to permit the end portion 22 of the electric cable 20 to extend therethrough.

Figure 6:
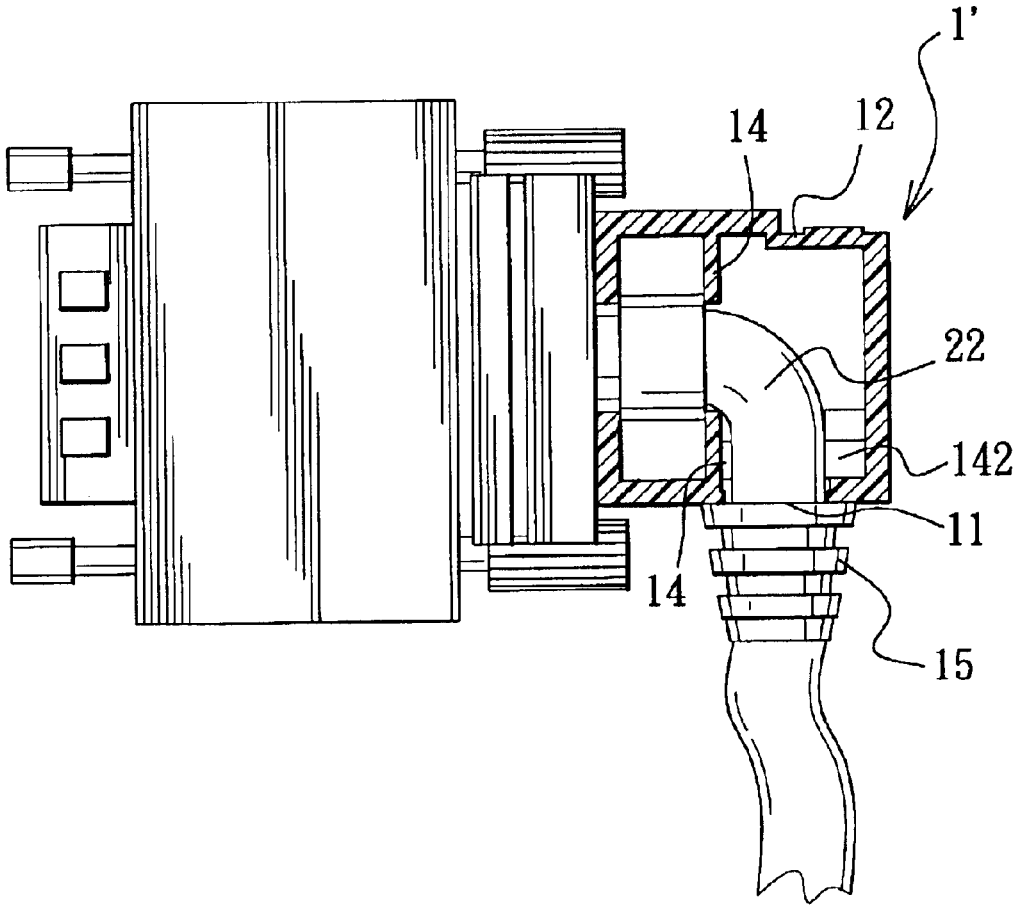
FIG. 6 is a partly sectional, top schematic view showing the second preferred embodiment of an electrical connector assembly according to the present invention.

FIG. 6 illustrates the second preferred embodiment of an electrical connector assembly according to the present invention, which is a modification of the first preferred embodiment. Unlike the previous embodiment, the electrical connector assembly further includes a flexible support tube 15 that is disposed around the end portion 22 of the electric cable 20, outwardly of the cable passage, and adjacent to the second through hole 11 of the cable guiding member 1'. Furthermore, in this embodiment, the positioning unit additionally includes a baffle block 140 disposed in the cable guiding member 1' adjacent to the second through hole 11.

Figure 7:
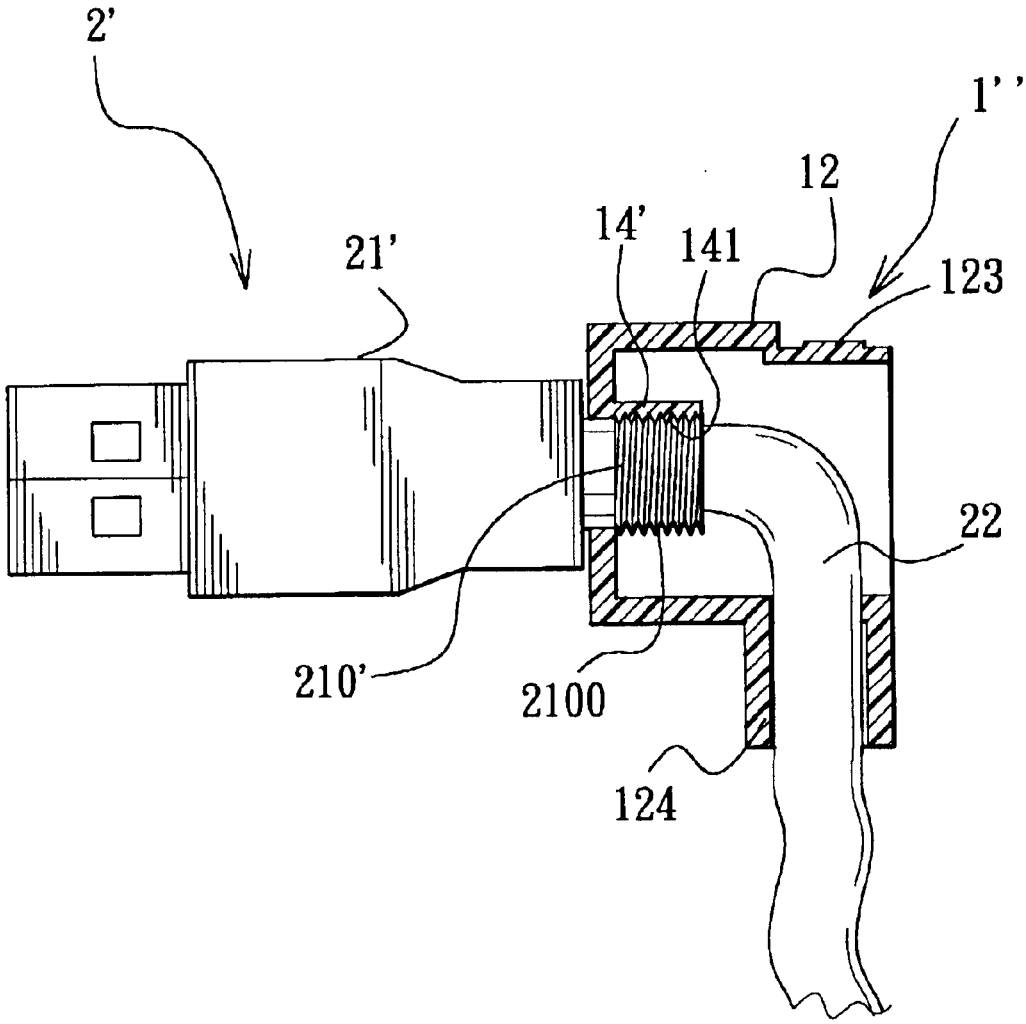
FIG. 7 is a partly sectional, top schematic view showing the third preferred embodiment of an electrical connector assembly according to the present invention.

FIG. 7 illustrates the third preferred embodiment of an electrical connector assembly according to the invention, which is a modification of the first preferred embodiment. Unlike the first preferred embodiment, the sleeve portion 210' of the connector housing 21' has a knurled outer surface 2100. Moreover, the positioning unit includes a positioning plate 14' having a teethed surface 141 for engaging the knurled outer surface 2100 of the sleeve portion 210'. Furthermore, the electrical connector assembly further includes a support tube 124 that is formed integrally with the cable guiding member 1".

To sum up, due to the presence of the cable guiding member, the electric cable can be guided toward a desired direction. The object of the invention is thus met.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector assembly comprising:

an electric cable having an end portion;

an electrical connector member for signal transmission, said connector member terminating said end portion of said electric cable; and a cable guiding member mounted on said end portion of said electric cable in rotatable relation to said electrical connector member and formed with a first through hole having a first hole axis, a second through hole having a second hole axis, and a cable passage communicated with said first and second through holes, said second hole axis forming an angle with said first through hole axis, said end portion of said electric cable extending into said cable passage via said first through hole and outwardly of said cable passage via said second hole.

2. The electrical connector assembly as claimed in claim 1, wherein said cable guiding member includes first and second casing parts, each of which has first and second casing parts, each of which as first and second notches, said first notches of said first and second casing parts confining said first through hole, said second notches of said first and second casing parts confining said second through hole.

3. The electrical connector assembly as claimed in claim 2, wherein said cable guiding member further includes a fastening unit for fastening together said firs and second casing parts.

4. The electrical connector assembly as claimed in claim 3, wherein said fastening unit includes a resilient lug formed on one of said first and second casing parts, and a projecting block formed on the other one of said first and second casing parts, said lug engaging said projecting block to fasten releasably said first and second casing parts to each other.

5. The electrical connector assembly as claimed in claim 2, wherein said connector member includes a connector housing formed with a sleeve portion that extends into said cable passage via said first through hole, said sleeve portion being formed with an annular engaging groove, each of said first notches of said first and second casing parts being formed with an inwardly extending engaging edge that engages said engaging groove to secure said connector member to said cable guiding member.

6. The electrical connector assembly as claimed in claim 2, wherein said connector member includes a connector housing formed with a sleeve portion that extends into said cable passage via said first through hole, said cable guiding member further including a positioning unit disposed therein for engaging said sleeve portion of said connector housing.

7. The electrical connector assembly as claimed in claim 6, wherein said positioning unit includes a baffle unit that abuts against a distal end of said sleeve portion and that is formed with an opening to permit said end portion of said electric cable to extend therethrough.

8. The electric connector assembly as claimed in claim 6, wherein said sleeve portion has a knurled outer surface, said positioning unit including a positioning plate having a teethed surface for engaging said knurled outer surface of said sleeve portion.

9. The electrical connector assembly as claimed in claim 1, further comprising a support tube disposed around said end portion of said electric cable, outwardly of said cable passage, and adjacent to said second through hole of said cable guiding member.

10. The electrical connector assembly as claimed in claim 9, wherein said support tube is formed integrally with said cable guiding member.

11. The electrical connector assembly as claimed in claim 1, wherein said electrical connector member is one of a universal serial bus connector, a PS/2 connector, a COM connector, an LPT connector and a digital video interface connector.

12. The electrical connector assembly us claimed in claim 1, wherein said second hole axis is transverse to said first hole axis.

13. A cable guiding member for an electric cable having an end portion terminated by an electrical connector member, the connector member including a connector housing formed with a sleeve portion, said cable guiding member comprising:

first and second casing parts, each or which has first and second notches, said first notches of first and second casing parts containing a first through hole with a first hole axis, said second notches of said first and casing parts confining a second through hole with a second hole axis, said first and second casing part further confining a cable passage communicated with said first and second through holes, said second hole axis forming an angle with said first hole axis, said first and second casing parts being adapted to permit the end portion of the electric cable to extend into said cable passage via said first through hole and outwardly of said cable passage via said second through hole, said first and second casing parts being adapted to permit the sleeve portion of the connector housing to extend into said cable passage via said first through hole; a positioning unit disposed in at lease one of said first and second casing parts and adapted to engage the sleeve portion of the connector housing;

a fastening unit for fastening together said first and second casing part; and wherein said fastening unit includes a resilient lug formed on one of said first acid second casing parts, and a projecting block formed on the other one of said first and second casing parts, said lug engaging said projecting block to fasten releasably said first and second casing parts to each other.

14. The cable guiding member as claimed in claim 13, wherein said positioning unit includes a baffle unit that is adapted to abut against a distal end of the sleeve portion and that is formed with an opening adapted to permit the end portion of the electric cable to extend therethrough.

15. The cable guiding member as claimed in claim 13, wherein said positioning unit includes a positioning plate having a teethed surface adapted to engage the sleeve portion.

16. The cable guiding member as claimed in claim 13, further comprising a support tube adapted to be disposed around the end portion of the electric cable, outwardly of said cable passage, and adjacent to said second through hold of said first and second casing parts.

17. The cable guiding member as claimed in claim 13, wherein said second hole axis is transverse to said first hole axis.

18. An electrical connector assembly comprising:

an electric cable having an end portion;

an electrical connector member for signal transmission, said connector member terminating said end portion of said electric cable;

a cable guiding member mounted on said end portion of said electric and formed with a first through hole having a first hole axis, a second through hole having a second hole axis, and a cable passage communicated with said first and second through holes, said second hole axis forming an angle with said first through hole axis, said end portion of said electric cable extending into said cable passage via said first through hole and outwardly of said cable passage via said second hole;

said cable guiding member includes first and second casing parts, each of which has first and second casing parts, each of which as first and second notches, said first notches of said first and second casing parts confining said first through hole, said second notches of said first and second casing parts confining said second through hole; and a fastening unit included in said guiding member adapted for fastening together said first and second casing parts, wherein said fastening unit includes a resilient lug formed on one of said first and second casing parts, and a projecting block formed on the other one of said first and second casing parts said lug engaging said projecting block to fasten releasably said first and second casing parts to each other.

19. The electrical connector assembly as claimed in claim 18, wherein said connector member includes a connector housing formed with a sleeve portion that extends into said cable passage via said first through hole, said sleeve portion being formed with an annular engaging groove, each of said first notches of said first and second casing parts being formed with an inwardly extending engaging edge that engages said engaging groove to secure said connector member to said cable guiding member.

* * * * *